US008311187B2

(12) United States Patent
Treas et al.

(10) Patent No.: US 8,311,187 B2
(45) Date of Patent: Nov. 13, 2012

(54) MAGNETRON POWERED LINEAR ACCELERATOR FOR INTERLEAVED MULTI-ENERGY OPERATION

(75) Inventors: Paul Dennis Treas, Livermore, CA (US); Roger Heering Miller, Mountain View, CA (US)

(73) Assignee: Accuray, Inc., Sunnyvale, CA (US)

( * ) Notice: Subject to any disclaimer, the term of this patent is extended or adjusted under 35 U.S.C. 154(b) by 268 days.

(21) Appl. No.: 12/697,031

(22) Filed: Jan. 29, 2010

(65) Prior Publication Data

US 2011/0188638 A1 Aug. 4, 2011

(51) Int. Cl.
*H05H 9/02* (2006.01)

(52) U.S. Cl. ..... 378/119; 315/505

(58) Field of Classification Search ..... 378/65, 378/119; 315/505

See application file for complete search history.

(56) References Cited

U.S. PATENT DOCUMENTS

| | | | |
|---|---|---|---|
| 2,920,228 | A | 1/1960 | Ginzton |
| 2,993,141 | A | 7/1961 | Post |
| 3,820,035 | A | 6/1974 | Meddaugh |
| 4,286,192 | A | 8/1981 | Tanabe et al. |
| 4,382,208 | A | 5/1983 | Meddaugh et al. |
| 4,629,938 | A | 12/1986 | Whitham |
| 4,713,581 | A | 12/1987 | Haimson |
| 5,796,314 | A | 8/1998 | Tantawi et al. |
| 5,801,598 | A | 9/1998 | Tantawi et al. |
| 5,949,811 | A | 9/1999 | Baba et al. |
| 6,366,641 | B1 | 4/2002 | Whitham |
| 6,459,761 | B1 | 10/2002 | Grodzins et al. |
| 6,459,762 | B1 | 10/2002 | Wong et al. |
| 7,005,809 | B2 | 2/2006 | Whitham et al. |
| 7,112,924 | B2 | 9/2006 | Hanna |
| 7,130,371 | B2 | 10/2006 | Elyan et al. |
| 7,202,486 | B2 | 4/2007 | Gentry et al. |
| 7,239,095 | B2 | 7/2007 | Ho et al. |
| 7,580,505 | B2 | 8/2009 | Kang et al. |
| 7,645,994 | B2 | 1/2010 | Tang et al. |
| 7,646,851 | B2 | 1/2010 | Liu et al. |
| 7,881,424 | B2 | 2/2011 | Zhang et al. |
| 2005/0057198 | A1 | 3/2005 | Hanna |
| 2007/0035260 | A1 | 2/2007 | Ho et al. |
| 2007/0215813 | A1 | 9/2007 | Whittum et al. |

(Continued)

FOREIGN PATENT DOCUMENTS

| | | | |
|---|---|---|---|
| JP | 2008-198522 | A | 8/2008 |

(Continued)

OTHER PUBLICATIONS

Aoi et al., "SU-FF-T-155: Development of an ultra-small C-band linear accelerator guide and automatic frequency controller." Med. Phys., vol. 34, issue 6, Jun. 2007, pp. 2436-2437.

(Continued)

*Primary Examiner* — Glen Kao

(74) *Attorney, Agent, or Firm* — Jones Day; Nicola A. Pisano; Jaime D. Choi

(57) ABSTRACT

The disclosure relates to systems and methods for interleaving operation of a linear accelerator that use a magnetron as the source of electromagnetic waves for use in accelerating electrons to at least two different ranges of energies. The accelerated electrons can be used to generate x-rays of at least two different energy ranges. In certain embodiments, the accelerated electrons can be used to generate x-rays of at least two different energy ranges. The systems and methods are applicable to traveling wave linear accelerators.

35 Claims, 7 Drawing Sheets

U.S. PATENT DOCUMENTS

| | | | | |
|---|---|---|---|---|
| 2007/0248214 | A1 | 10/2007 | Smith | |
| 2008/0037843 | A1 | 2/2008 | Fu et al. | |
| 2010/0034355 | A1 | 2/2010 | Langeveld et al. | |
| 2010/0038563 | A1* | 2/2010 | Chen et al. | 250/503.1 |
| 2010/0111388 | A1 | 5/2010 | Seppi et al. | |
| 2010/0188027 | A1 | 7/2010 | Treas et al. | |
| 2010/0310045 | A1* | 12/2010 | Brown et al. | 378/65 |
| 2011/0006708 | A1 | 1/2011 | Ho et al. | |

FOREIGN PATENT DOCUMENTS

| | | | |
|---|---|---|---|
| JP | 2008-218053 | A | 9/2008 |
| WO | WO 2007/134514 | A1 | 11/2007 |
| WO | WO 2009/080080 | A1 | 7/2009 |
| WO | WO 2010/019228 | A2 | 2/2010 |

OTHER PUBLICATIONS

Birdsey et al., "Pierce geometry electron guns as off-the-shelf nanosecond pulsed electron sources," Australian Institute of Physics 17th National Congress, Brisbane, Dec. 3-8, 2006, 4 pages.

Chetverikov et al., "The tuning method of the biperiodic accelerating structure of electron linear accelerator," Problems of Atomic Science and Technology (PAST), Ukraine, 2001, No. 3, pp. 99-100.

Dovbnya et al, "Two-frequency klystron amplifier," XVIII International Linac Conference, Geneva, Switzerland, Aug. 26-30, 2006, 3 pages.

Green, "Linear accelerators for radiation therapy, second edition" Taylor & Francis Group, New York, NY, pp. 27-47 (1997).

Guo et al., "Active RF pulse compression using an electrically controlled semiconductor switch," New Journal of Physics 8 (2006) 293, 17 pages.

Guo et al., "Active RF pulse compression using electrically controlled semiconductor switches," Contributed to 12th Advanced Accelerator Concepts Workshop (AAC 2006), Jul. 10, 2006 to Jul. 15, 2006, Lake Geneva, Wisconsin, 7 pages.

Guo et al., "Active RF pulse compression using electrically controlled semiconductor switches," Proceedings of EPAC 2006, Edinburgh, Scotland, pp. 3140-3142 , (2006).

Huang et al, "Electron gun used in the accelerator for customs inspection systems," Proceedings of the Second Asian Particle Accelerator Conference, Beijing, China, 2001, 3 pages.

Iwashita, "Disk-and-washer LINAC structure with biperiodic T supports," IEEE Transactions on Nuclear Science, vol. NS-30, No. 4, Aug. 1983, pp. 3542-3544.

Jang et al., "Perveanee monitor for measuring an 80-MW klystron characteristics," Proceedings of APAC 2004, Gyeongju, Korea, pp. 610-612 , (2004).

Kamino et al., "Development of a new concept automatic frequency controller for an ultrasmall C-band linear accelerator guide," Med. Phys., vol. 34, issue 8, Aug. 2007, pp. 3243-3248.

Khodak et al., "Electron gun for technological linear accelerator," Problems of Atomic Science and Technology (PAST), Ukraine, 2000, No. 2, pp. 86-88.

Miller et al., "Comparison of standing-wave and traveling-wave structures," Invited paper presented at the Stanford Linear Accelerator Conference, Stanford, California, Jun. 2-6, 1986, 6 pages.

Nantista et al., "Calculating RF profiles for beam loading compensation of arbitrary current profiles," Next Linear Collider (NLC) Note #25, Aug. 1997, 11 pages.

Ogorodnikov et al., "Processing of interlaced images in 4-10 MeV dual energy customs system for material recognition," Physical Review Special Topics—Accelerators and Beams, vol. 5, 104701 (2002), 11 pages.

Oki et al., "Low output-impedance RF system for beam loading compensation," Research Center for Nuclear Physics (RCNP) Annual Report 2001, Osaka University, Japan, 2 pages , (2001).

Tamura et al. "Development of high-power X-band semiconductor microwave switch for pulse compression systems of future linear colliders," Physical Review Special Topics—Accelerators and Beams, vol. 5, 062001 (2002), 16 pages.

International Search Report for PCT/US2010/021919, 3 pages, mailed Jun. 30, 2010.

Written Opinion of the International Searching Authority for PCT/US2010/021919, 8 pages, mailed Jun. 30, 2010.

Hanna, "Review of Energy Variation Approaches in Medical Accelerators," Proceedings of EPAC08 Genoa, Italy, pp. 1797-1799 (Jul. 2008).

International Search Report for PCT/US2010/040864, 4 pages, mailed Nov. 11, 2010.

Written Opinion of the International Searching Authority for PCT/US2010/040864, 9 pages, mailed Nov. 11, 2010.

U.S. Appl. No. 12/718,901, filed Mar. 5, 2010, Ho et al.

U.S. Appl. No. 12/976,810, filed Dec. 22, 2010, Cheung et al.

U.S. Appl. No. 12/976,787, filed Dec. 22, 2010, Cheung et al.

Karzmark et al., "Medical Electron Accelerators," McGraw-Hill, Inc., 1993, pp. 82-87.

Maciszewski et al., "Application of 'Electronica 10-10' Electron Linac for Food Processing," $4^{th}$ European Particle Accelerator Conference, Jun. 27-Jul. 1, 1994, London, England, pp. 2644-2646.

Pirozhenko, "Efficient Traveling-Wave Accelerating Structure for Linear Accelerators," Proceedings of EPAC08, Jun. 23-27, 2008, Genoa, Italy, pp. 2746-2748.

International Search Report for PCT/US2011/022834, mailed May 24, 2011, 4 pages.

Written Opinion of the International Searching Authority for PCT/US2011/022834, mailed May 24, 2011, 7 pages.

D'Auria et al., "A New Electron Gun Modulator for the LINAC," Proceedings of LINAC96, Aug. 1996, pp. 854-856.

Hernandez et al., "A 7MeV S-Band 2998MHz Variable Pulse Length Linear Accelerator System," Proceedings of 2005 Particle Accelerometer Conference, Knoxville, Tennessee, pp. 1895-1897.

Pont et al. "Status of the 100 MeV Preinjector for the ALBA Synchrotron," Proceedings of EPAC08, Jul. 2008, Genoa, Italy, pp. 811-813.

Purdy et al., "Dual energy x-ray beam accelerators in radiation therapy: an overview," Nuclear Instruments and Methods in Physics Research B10/B11, 1985, pp. 1090-1095.

Toma et al. "Aspects of the Control System for the Electron Linear Accelerators Built in Romania," International Conference on Accelerator and Large Experimental Physics Control Systems, 1999, Trieste, Italy, pp. 654-656.

USPTO Non-Final Office Action for U.S. Appl. No. 12/499,644, mailed Nov. 15, 2011, 11 pages.

USPTO Non-Final Office Action for U.S. Appl. No. 12/581,086, mailed Nov. 8, 2011, 6 pages.

USPTO Non-Final Office Action for U.S. Appl. No. 12/718,901, mailed Mar. 5, 2012, 13 pages.

* cited by examiner

MAGNETRON POWERED LINEAR ACCELERATOR FOR INTERLEAVED MULTI-ENERGY OPERATION

1. TECHNICAL FIELD

Provided herein are systems and methods for interleaving operation of a linear accelerator that use a magnetron as the source of electromagnetic waves for use in accelerating electrons to at least two different ranges of energies. The accelerated electrons can be used to generate x-rays of at least two different energy ranges.

2. BACKGROUND

Linear accelerators (LINACs) can be used for various applications, including medical applications (such as radiation therapy and imaging) and industrial applications (such as radiography, cargo inspection and food sterilization). Beams of electrons accelerated by a LINAC can be directed at the sample or object of interest for performing the desired procedure or analysis. However, it may be preferable to use x-rays to perform the procedure or analysis in some applications. For example, high energy x-ray beams, produced by a cargo inspection device using a traveling wave (TW) LINAC, can be used for inspecting filled shipping containers. These x-rays can be generated by directing the electron beams from a LINAC at a x-ray emitting target.

Beams of electrons are accelerated in a LINAC by an electromagnetic wave coupled into the LINAC. Conventionally, a klystron can be used as the electromagnetic wave source of a LINAC, due to the control that can be exercised over the frequency of the electromagnetic wave generated by a klystron. However, magnetrons can be comparatively less expensive than klystrons, and can be made more compact in size, which can be advantageous for many applications. It can be difficult to operate a magnetron-powered LINAC to generate outputs of electron beams at two or more different energies based on changing the frequency of the electromagnetic wave from the magnetron, since relatively limited control can be exercised over the frequency of the electromagnetic wave from a magnetron.

Systems and methods are disclosed herein for a multi-x-ray energy operation of a LINAC powered by a magnetron.

3. SUMMARY

As disclosed herein, a system and method are provided for generating a high dose rate of electrons of different energies using a traveling wave linear accelerator that is fed electromagnetic waves by a magnetron. The system and method comprise coupling a first electromagnetic wave generated by a magnetron into the accelerator, ejecting a first beam of electrons from an electron gun into the accelerator, wherein the first beam of electrons is accelerated by the first electromagnetic wave to a first range of energies and output at a first captured electron beam current, coupling a second electromagnetic wave generated by the magnetron into the accelerator, and ejecting a second beam of electrons from the electron gun, wherein the second beam of electrons is accelerated by the second electromagnetic wave to a second range of energies and output at a second captured electron beam current, where the magnitude of the second captured electron beam current is different from the magnitude of the first captured electron beam current, and the central value of the second range of energies is different from a central value of the first range of energies.

In some embodiments, the magnitude of the second captured electron beam current can differ from the magnitude of the first captured electron beam current by about 160 mA, and the central value of the second range of energies can differ from the central value of the first range of energies by about 3 MeV. The magnitude of the second captured electron beam current can differ from the magnitude of the first captured electron beam current by about 53 mA for each approximately 1 MeV difference between the central value of the second range of energies and the central value of the first range of energies. The second range of energies and the first range of energies can be interleaved. The central value of the first range of energies and the central value of the second range of energies can be a median value or an average value.

The system and method can, in some embodiments, further comprise monitoring a first phase shift of the first electromagnetic wave using a frequency controller interfaced with an input and an output of the accelerator structure, where the frequency controller compares a phase of the first electromagnetic wave at the input of the accelerator structure to a phase of the first electromagnetic wave near the output of the accelerator structure to determine a phase shift, and transmits a tuning signal to a tuner based on the phase shift.

The magnitude of the second captured electron beam current can be less than the magnitude of the first captured electron beam current, and the central value of the second range of energies can be greater than the central value of the first range of energies. The magnitude of the second captured electron beam current alternatively can be greater than the magnitude of the first captured electron beam current, and the central value of the second range of energies is less than the central value of the first range of energies.

The second pulse length of the second beam of electrons can be longer than the first pulse length of the first beam of electrons. Alternatively, the second pulse length of the second beam of electrons can be shorter than a first pulse length of the first beam of electrons.

A frequency of the first electromagnetic wave can be approximately equal to a frequency of the second electromagnetic wave, and an amplitude of the first electromagnetic wave can be approximately equal to an amplitude of the second electromagnetic wave. In certain embodiments, the frequency of the second electromagnetic wave can be slightly different from the first frequency, e.g., can vary from that of the first frequency by less than about 0.002%.

A system and method also are provided for generating beam of x-rays at two different ranges of x-ray energies from a target positioned near a first end of a traveling wave linear accelerator that is fed electromagnetic waves by a magnetron. An electron gun is positioned at a second end of the accelerator opposite to the first end. The system and method comprise coupling a first electromagnetic wave generated by the magnetron into the accelerator, ejecting a first beam of electrons from an electron gun into the accelerator, where the first beam of electrons is accelerated by the first electromagnetic wave to a first range of energies and output at a first captured electron beam current, contacting the target with the first beam of electrons at the first energy, thereby generating a first beam of x-rays having energies in a first range of x-ray energies from the target, coupling a second electromagnetic wave generated by the magnetron into the accelerator, ejecting a second beam of electrons from the electron gun, wherein the second beam of electrons is accelerated by the second electromagnetic wave to a second range of energies and output at a second captured electron beam current, where the magnitude of the second captured electron beam current is different from the magnitude of the first captured electron beam current, and a central value of the second energy is different from a central value of the first energy, and contacting the target with the second beam of electrons at the second energy, thereby generating a second beam of x-rays having energies in a second range of x-ray energies from the target.

In some embodiments, the second range of x-ray energies and the first range of x-ray energies can be interleaved. The magnitude of the second captured electron beam current can differ from the magnitude of the first captured electron beam current by about 53 mA for each approximately 1 MeV difference between the central value of the second range of energies and the central value of the first range of energies. The central value of the first range of energies and the central value of the second range of energies can be a median value or an average value.

The method can, in some embodiments, further comprise monitoring a first phase shift of the first electromagnetic wave using a frequency controller interfaced with an input and an output of the accelerator structure, where the frequency controller compares a phase of the first electromagnetic wave at the input of the accelerator structure to a phase of the first electromagnetic wave near the output of the accelerator structure to determine a phase shift, and the frequency controller transmits a tuning signal to a tuner based on the phase shift.

In some embodiments, the magnitude of the second captured electron beam current can be less than the magnitude of the first captured electron beam current, and the central value of the second range of x-ray energies can be greater than the central value of the first range of x-ray energies. The magnitude of the second captured electron beam current alternatively can be greater than the magnitude of the first captured electron beam current, and the central value of the second range of x-ray energies can be less than the central value of the first range of x-ray energies.

The second pulse length of the second beam of electrons can be longer than the first pulse length of the first beam of electrons. Alternatively, the second pulse length of the second beam of electrons can be shorter than a first pulse length of the first beam of electrons.

The second frequency can be approximately equal to the first frequency and the first amplitude can be approximately equal to the second amplitude. In certain embodiments, the second frequency can be slightly different from the first frequency, e.g., can vary from the first frequency by less than about 0.002%.

A traveling wave linear accelerator also is provided that comprises an accelerator structure having an input and an output, a magnetron coupled to the accelerator structure to provide an electromagnetic wave to the accelerator structure, an electron gun interfaced with the input of the accelerator structure, and a controller interfaced with the electron gun. The controller can transmit a first signal to cause the electron gun to eject a first beam of electrons into an input of the accelerator, where the first beam of electrons is accelerated to a first range of energies and output at a first captured electron beam current. The controller can transmit a second signal to cause the electron gun to eject a second beam of electrons into the input of the accelerator, where the second beam of electrons is accelerated to a second range of energies and output at a second captured electron beam current. The magnitude of the second captured electron beam current can be different from the magnitude of the first captured electron beam current, and the central value of the second range of energies can be different from the central value of the first range of energies.

In some embodiments, the first range of energies and the second range of energies can be interleaved. The traveling wave linear accelerator can further comprise a frequency controller interfaced with the input and output of the accelerator structure, where the frequency controller compares the phase at the input of the accelerator structure of a first electromagnetic wave having a first frequency to the phase of the first electromagnetic wave near the output of the accelerator structure to detect a phase shift of the first electromagnetic wave, where the frequency controller transmits a tuning signal to a tuner.

4. BRIEF DESCRIPTION OF THE DRAWINGS

The present invention is illustrated by way of example, and not by way of limitation, in the figures of the accompanying drawings.

FIGS. 1A-B illustrate the unloaded field, the beam induced field, and the beam loaded field of a traveling wave (TW) linear accelerator (LINAC) (FIG. 1A) and a standing wave (SW) LINAC (FIG. 1B).

5. DETAILED DESCRIPTION

Figure 1A:
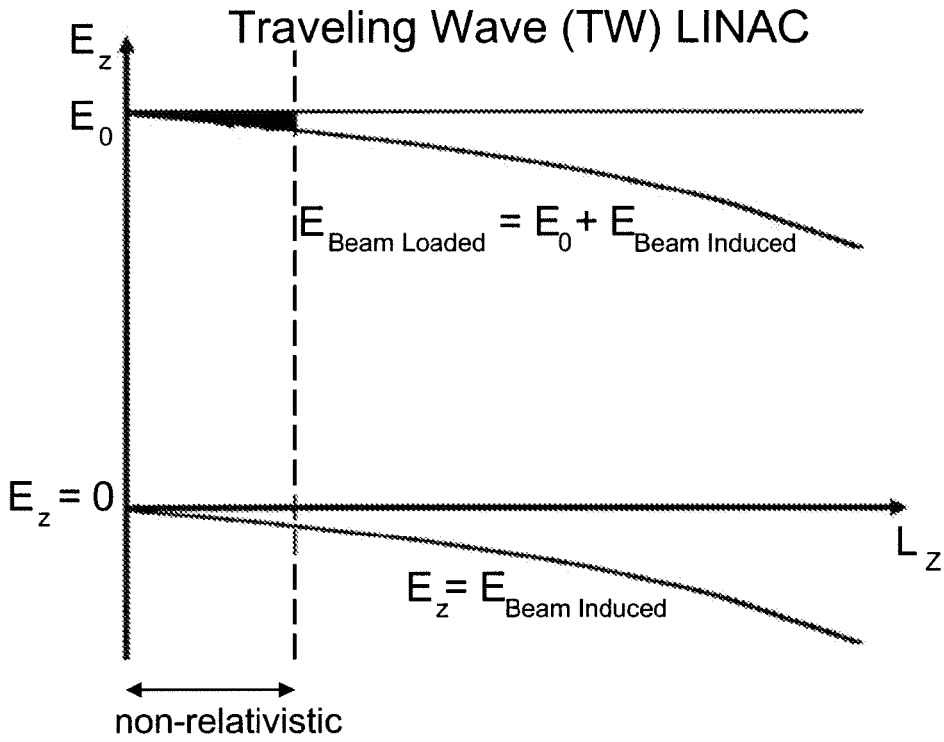

Provided herein are methods and systems that use a magnetron as a source of electromagnetic waves to a TW LINAC in a multi-energy operation. The electromagnetic waves can be used to accelerate bunches of electrons injected into an accelerator structure to generate an output of electrons. These accelerated electrons can be directed at a target to provide highly stable, highly efficient X-ray beams. The LINAC can be tuned to multiple different energies to provide a highly stable, highly efficient output of electrons at each different energy. In an interleaving operation, the LINAC can provide an output of electrons that alternates between two or more different energies for each pulse. As discussed in Section 5.1 below, the energy of operation of the LINAC can be changed by varying the captured electron beam current (a measure near the output of the LINAC of the electron beam current originating from the electron gun). The pulse length of the beam of electrons from the electron gun can also be varied to maintain a substantially similar dose of electrons in each pulse or a similar yield of x-rays in each pulse (see Section 5.1.2).

5.1 Magnetron Powered Multi-Energy LINAC

Use of a magnetron as a source of electromagnetic waves for a LINAC can provide several advantages over a klystron. For example, a magnetron can be cheaper than a klystron. Also, a magnetron uses a simpler control system, since it conventionally does not utilize an external oscillator or an amplifier. Thus, a LINAC that can utilize a magnetron as the source of electromagnetic waves in an interleaved multi-energy operation can offer several advantages over a LINAC that uses a klystron.

Since a magnetron is an oscillator, it can be less agile with respect to frequency tuning or power level of operation than a klystron (an amplifier for which both frequency and output power can be tuned using a low power external driver). That is, it can be more difficult to modify the frequency or power level of a magnetron than a klystron. A system and method is provided herein that uses a beam loading effect to provide outputs of electrons at different energies from a LINAC that receives electromagnetic waves from a magnetron. In certain embodiments, the system and method need not use the magnetron to vary the frequency or power level of an electromagnetic wave. The system and method can facilitate different energy outputs of the LINAC substantially without modification to the frequency or power level of the magnetron.

5.1.1 Beam Loading Effect

The different energy outputs of the LINAC that receives electromagnetic waves from a magnetron can be achieved through a beam loading effect, by changing the captured electron beam current. The captured electron beam current is the beam of electrons measured near the output of the LINAC. The amount of the captured electron beam current can be controlled, e.g., by varying the electron beam current originating at the electron gun. The captured beam current typically has a magnitude less than the electron beam current originating from the electron gun. For example, the captured beam current can be up to about 15%, about 20%, about 25%, about 30%, about 35%, about 40%, about 45%, or up to about 50% or more of the electron beam from the electron gun. The difference between the captured electron beam current and the electron beam current originating at the electron gun can depend on the structure of the LINAC and can be readily ascertained by one of ordinary skill in the art. Furthermore, it would be readily apparent to one of ordinary skill in the art how to determine, for a given LINAC, the amount of captured beam current that can be obtained for a given amount of electron beam current originating from the electron gun. For example, a skilled practitioner can operate a LINAC at several different levels of electron beam current originating at the electron gun and measure the corresponding captured electron beam current. The captured beam current can be measured by a monitor positioned near the output of the LINAC.

In the beam loading effect, the accelerating electron beam can induce a beam loaded field in the LINAC having a phase that opposes the acceleration applied by the electromagnetic wave coupled into the LINAC from the magnetron. That is, beam loading can induce a beam loaded field that acts to decelerate the electron beam. The amplitude of the beam induced field varies monotonically with the electron beam current. A higher electron beam current can induce electric fields of higher amplitude that oppose the acceleration applied by the electromagnetic wave coupled into the LINAC, and result in the electron beam experiencing less acceleration. The lower strength electromagnetic wave accelerates the electron bunches at a slower rate than the higher strength electromagnetic waves. The effect of beam loading is essentially to decrease the amplitude of the electromagnetic wave accelerating the electron beam. A desirable result of increasing the electron beam current (and hence the effect of beam loading) to lower the energy of the output electrons is that the increased current can partially or fully compensate for the lower x-ray yield produced by the lower energy.

Figure 1B:
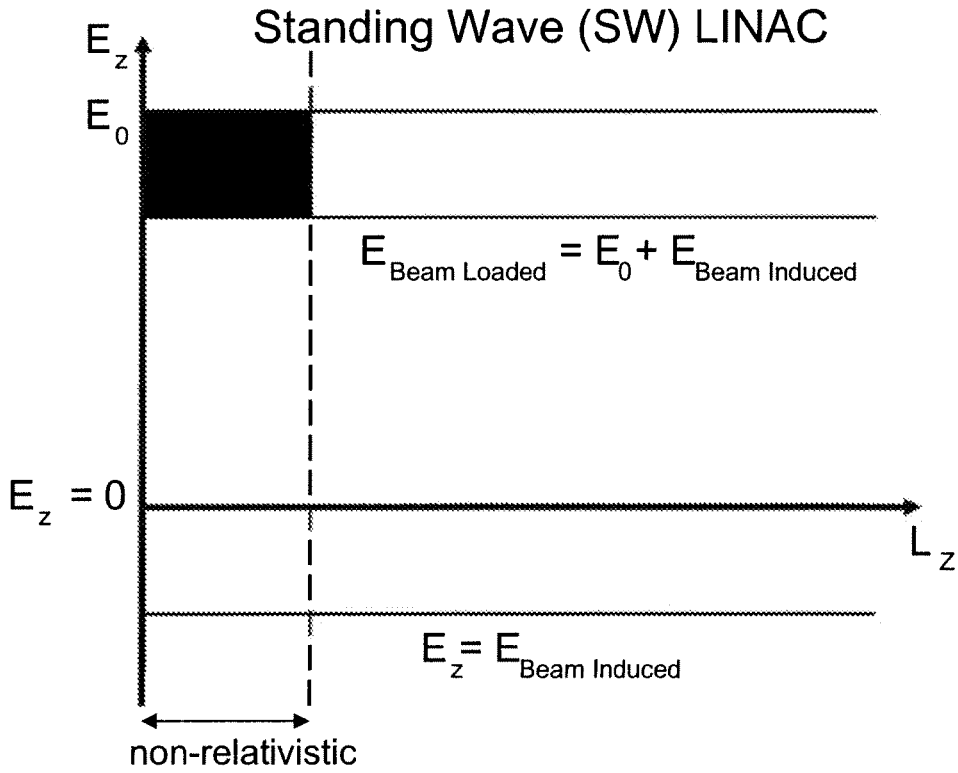

The change in amplitude of the electromagnetic wave as a result of the beam loading effect can occur in both the buncher cavities and the accelerating cavities of the accelerator structure of the LINAC. The characteristics of the beam loaded field in a constant gradient TW LINAC with a forward wave is illustrated in FIG. 1A. FIG. 1B illustrates the characteristics of the beam loaded field in a standing (SW) LINAC.

FIG. 1A illustrates a constant field $E_0$ (horizontal line) in the TW LINAC in the absence of beam loading. The character of the beam induced field in the TW LINAC results from the fact that the beam is synchronous only with one forward wave, and each unit length of the LINAC adds a roughly equal increment of field to that wave. The field increments (not power increments) add monotonically. The output coupler is matched for the synchronous wave, and the beam induced field varies monotonically with distance $L_Z$ along the length of the LINAC. In the illustration of FIG. 1A, the magnitude of the beam induced field $E_{Beam\ Induced}$ varies monotonically with length along the LINAC structure $L_Z$, increasing in magnitude with $L_Z$, but in the negative direction. The monotonic rise in magnitude of $E_{Beam\ Induced}$ is a reasonable approximation of the field near the buncher region of a constant gradient LINAC structure. The phase of the beam induced field is such that it decelerates the synchronous beam and thus can be approximated as roughly 180 degrees out of phase with the unloaded field ($E_0$). Thus the beam induced field varies monotonically in magnitude and is opposite to $E_0$ (thus it is shown in FIG. 1A as negative). The beam loaded field ($E_{Beam\ Loaded}$), which is the sum of the constant unloaded field $E_0$ (horizontal line) and the beam induced field $E_{Beam\ Induced}$ ($E_{Beam\ Loaded}=E_0+E_{Beam\ Induced}$), illustrated in FIG. 1A as a steadily decreasing field, is equal to the unloaded field at $L_Z=0$ and decreases monotonically with increasing $L_Z$.

The effect of special relativity can be considered as follows. An electron with a kinetic energy of ½ MeV has a velocity of approximately 85% of the velocity of light. It can take an infinite amount of energy to accelerate an electron that last 15% to the velocity of light. A value of electron energy of ½ MeV can be determined as a dividing line between non-relativistic and relativistic velocity of the electrons. In other example systems, the dividing line between non-relativistic and relativistic velocity of the electrons can be determined to be greater than or less than ½ MeV. The dashed vertical line in FIG. 1A can serve as a demarcation for when the electrons attain relativistic speeds. In an embodiment, above ½ MeV (the relativistic region) the velocity of the electrons is less sensitive to the energy of the beam. Thus, the lagging of the electron beam behind the crest of the electromagnetic wave for a 6 MeV beam relative to a 9 MeV beam occurs in the first ½ MeV of acceleration.

If the energy difference is caused entirely by beam loading, the field difference (between the unloaded field and the beam loaded field) in the first ½ MeV in a TW LINAC can be very small (identified by the shaded region in FIG. 1A). As a result, the phase shift can be small, therefore, the beam loading effect can produce less phase error in a TW LINAC. If the frequency is adjusted to put the high energy beam ahead of the crest of the electromagnetic wave by about the same amount as the lower energy beam is behind the crest, both beams can be close enough to the crest to provide an output of electrons with reasonable spectra and stability. The correction of phase shift of the electromagnetic wave from the input to the output ends of a TW LINAC, and the operation of a TW LINAC to position the electron bunch relative to the crest of the traveling electromagnetic wave, are disclosed in co-pending U.S. Nonprovisional application Ser. No. 12/581,086, which is incorporated herein by reference in its entirety.

FIG. 1B illustrates the characteristics of the beam loaded field in a SW LINAC. In an example SW LINAC, there are two waves which are synchronous with the beam: (1) a forward wave in which there can be roughly no phase shift, relative to the beam, from cavity to cavity (of the LINAC structure), and (2) a backward wave in which there can be a roughly $2n\pi$ phase shift (where n is an integer), relative to the beam, from cavity to cavity. The beam excites both forward and backward waves equally, and thus excites a (beam loaded) standing wave that is approximately 180° out of phase of the unloaded field. The beam induced field $E_{Beam\ Induced}$ is illustrated in FIG. 1B as a negative value (it decelerates the beam) and having a constant magnitude along the length of the LINAC structure $L_Z$. The beam loaded field, which is the sum of the constant unloaded field $E_0$ (horizontal line) and the beam induced field $E_{Beam\ Induced}$ ($E_{Beam\ Loaded}=E_0+E_{Beam\ Induced}$), is illustrated in FIG. 1B as a substantially constant field, i.e., a field that has substantially the same value at $L_Z=0$ and with increasing $L_Z$. Therefore, in a SW LINAC, the beam loaded fields in the first ½ MeV, which can be considered the non-relativistic region, are approximately the same as in the rest of the SW LINAC structure. The beam loading effect in a SW LINAC can produce greater phase error in the first ½ MeV. Note that embodiments of the present invention use TW LINACs, not SW LINACs.

5.1.2 System and Method of Operating a Multi-Energy Magnetron Powered LINAC

Systems and methods are provided for operating a TW LINAC that uses electromagnetic waves received from a magnetron to accelerate electrons so that the TW LINAC provides outputs of electrons at two or more different energies.

Figure 2:
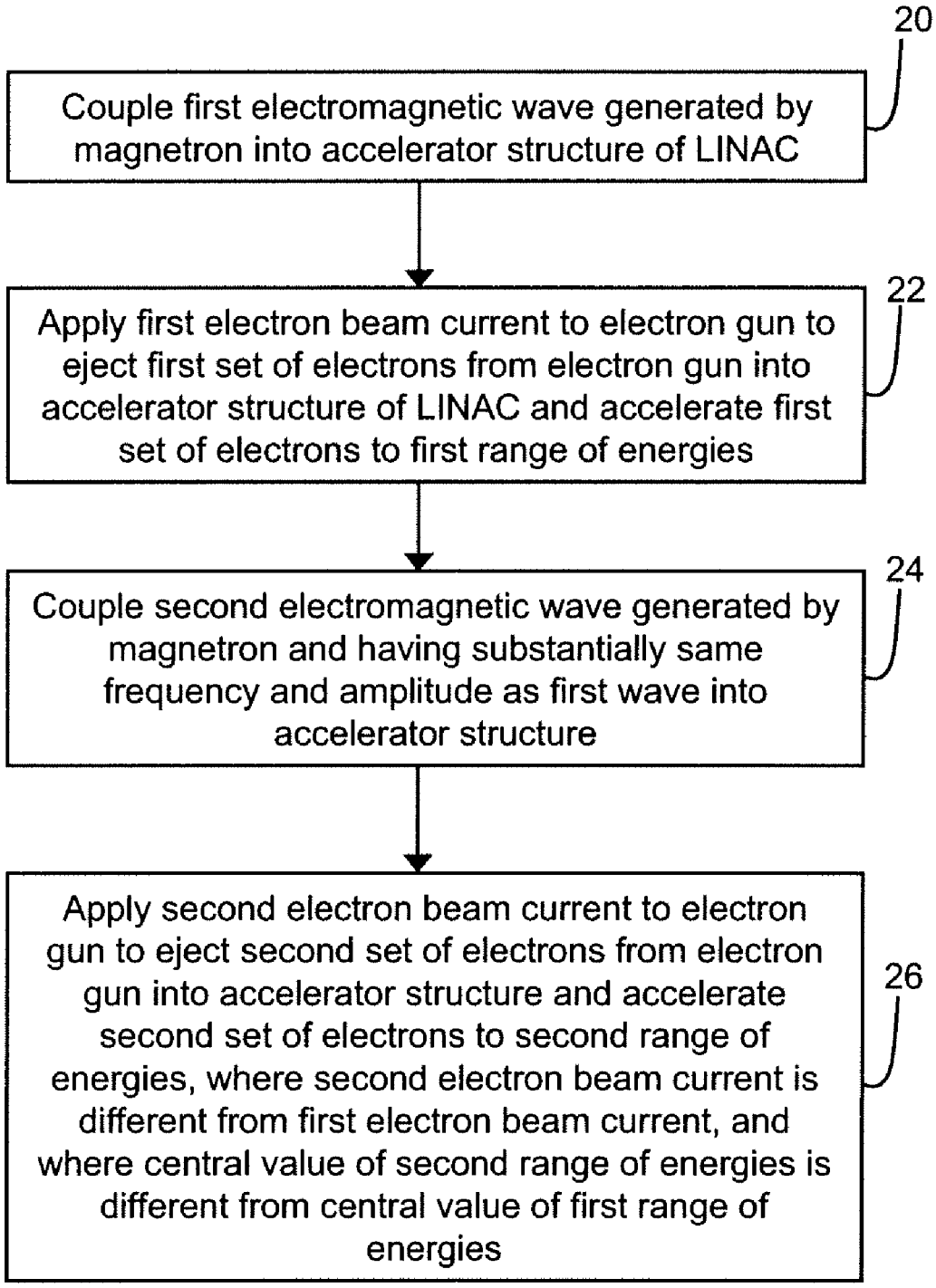
FIG. 2 shows a flow chart of an operation of a LINAC that is powered by a magnetron.

FIG. 2 shows a flow chart of steps in an example operation of a TW LINAC that uses electromagnetic waves received from a magnetron to accelerate electrons. In step 20 of FIG. 2, a first electromagnetic wave, generated by a magnetron, is coupled into the accelerator structure of the LINAC. In step 22, an electron gun ejects into an input of the accelerator structure of the LINAC a first set of electrons from the electron gun (which can be obtained, for example, by applying a first gun current command to the electron gun). The first set of electrons is accelerated to a first range of output energies using the electromagnetic wave generated by the magnetron, and output at a first captured electron beam current. In step 24, a second electromagnetic wave, generated by a magnetron, is coupled into the accelerator structure of the LINAC. In one example, the second electromagnetic wave can have substantially the same frequency and substantially the same amplitude as the first electromagnetic wave of step 20. In another example, the second electromagnetic wave can have a second frequency that is slightly different from the first frequency of the first electromagnetic wave of step 20, e.g., that varies by less than 0.002% of that of the first electromagnetic wave. In step 26, the electron gun ejects a second set of electrons (which can be obtained, for example, by applying a second gun current command to the electron gun) into the input of the accelerator structure. The second gun current can be different from the first gun current. The second set of electrons is accelerated to a second range of output energies using the electromagnetic wave generated by the magnetron and output at a second captured electron beam current. The second captured electron beam current can be different from the first captured electron beam current. The central value (e.g., the mean value or median value) of the second range of electron output energies can be different from the central value (the respective mean value or median value) of the first range of electron output energies when the second gun current is different from the first gun current, or when the second captured electron beam current is different from the first captured electron beam current. The central values of the first and second ranges of electron output energies are different if they differ by greater than about 1% in magnitude, greater than about 2% in magnitude, greater than about 5% in magnitude, greater than about 10% in magnitude, or more. Steps 20-26 can be repeated a number of times during operation of the LINAC.

For example, in an interleaving operation, the LINAC can be operated to cycle between the two different ranges of electron output energies. For example, the LINAC can be operated to alternate between about 6 MeV and about 9 MeV for each pulse, with the second captured electron beam current (which can be obtained by applying a second gun current command to the electron gun) being different from the first captured electron beam current (which can be obtained by applying a first gun current command to the electron gun), from pulse to pulse. In another example, the LINAC can be operated for multiple pulses with the electron gun providing a first captured electron beam current for each of the multiple pulses and each of the first set of electrons being accelerated to the first range of output energies, before the LINAC is operated for additional multiple pulses with the electron gun providing a second captured electron beam current for each of the additional multiple pulses and each of the second set of electrons being accelerated to the second range of output energies. That is, the LINAC can also be operated to provide multiple pulses at the first energy and then operated to provide multiple pulses at the second energy.

The second captured electron beam current can differ from the first captured electron beam current by a fixed magnitude of electron beam current for the desired energies of operation. That is, the energy of an example LINAC can be changed by a fixed amount depending on the energy difference between the central value of the first range of electron output energies and the central value of the second range of electron output energies. In an example, a difference of output energies of about 3 MeV for the two different energies of operation can be obtained if the difference in the magnitude of the first captured beam current from the first output of electrons and the magnitude of the second captured beam current from the second output of electrons is about 160 mA.

The value of the difference in the magnitude of the first captured beam current from the first output of electrons and the magnitude of the second captured beam current from the second output of electrons can depend on the length of the LINAC structure and the shunt impedance of the LINAC structure, and in some embodiments can be higher or lower than about 160 mA. For example, the difference in magnitude of 160 mA between the first captured beam current and the second captured beam current can be applicable to a X-band TW LINAC having a length of about 0.5 m. The captured beam current can be up to about 15%, about 20%, about 25%, about 30%, about 35%, about 40%, about 45%, or up to about 50% or more of the electron beam from the electron gun.

In an embodiment, the lost electron beam (i.e., the portion of the electron beam that is not captured beam) may not contribute much to the beam loading effect. In this example, if a captured electron beam current of about 25 mA provides an output energy of about 9 MeV, a captured electron beam current of about 185 mA can provide an output energy of about 6 MeV. If the LINAC is operated at a third energy range with central value of output energy of about 7.5 MeV, the captured electron beam current would be about 105 mA.

The magnetron can be configured to run at a single frequency that optimizes the energy spectra of each of the different energies of operation of the LINAC. For example, the LINAC can be operated at about 9 MeV and 6 MeV interleaved with the magnetron operating at a single frequency and generating electromagnetic waves of substantially the same power amplitude from pulse to pulse. In another example, the LINAC can be operated at about 8 MeV and 5 MeV and a good spectrum can be obtained at both energies, by just changing the captured electron beam current with the magnetron operating at the same single frequency and generating electromagnetic waves of substantially the same power amplitude from pulse to pulse.

In an embodiment where the LINAC is operated to accelerate a first beam of electrons to a first range of energies and a second beam of electron to a second range of energies, and the central value of the second range of energies is greater than the central value of the first range of energies, then the magnitude of the second captured electron beam current would be less than the magnitude of the first captured electron beam current. The second captured electron beam current can be lower than the first captured electron beam current, for example, by a factor of about 2, about 3, about 4, about 5, about 8, about 10 or more. That is, in step 22, a first gun current is applied to the electron gun to eject the first set of electrons from the electron gun into the input of the accelerator structure of the LINAC. In step 26, a second gun current that is lower than the first gun current, for example, by a factor of about 2, about 3, about 4, about 5, about 8, about 10 or more, is applied to the electron gun to eject a second set of electrons from the electron gun into the input of the accelerator structure of the LINAC. In this embodiment, the output of x-rays from the two different energies of operation can be maintained at similar x-ray intensities (at a detector). That is, the magnitude of the second gun current applied to the electron gun can be set at a value such that the second captured electron beam current bombarding the target produces substantially the same dose of x-rays as that obtained from bombarding the target with the first captured electron beam current (relative to the first gun current applied to the electron gun).

In another example, the beam pulse length from the electron gun can be changed to maintain substantially the same electron beam charge, or alternately substantially the same x-ray yield, from pulse to pulse for the different energies of operation. That is, in step 22, the electron gun ejects the first set of electrons from the electron gun with a first pulse length into the input of the accelerator structure of the LINAC. In step 26, the electron gun ejects a second set of electrons from the electron gun with a second pulse length into the input of the accelerator structure of the LINAC. In an embodiment where the second range of electron output energies has higher central value of energy than that of the first range of electron output energies, the second pulse length can be longer than the first pulse length, for example, by a factor of about 2, about 3, about 4, about 5, about 8, about 10 or more. The change in pulse length also can be used to maintain the dose of x-rays from the two different energies of operation at substantially similar x-ray intensities (at a detector).

In an example, a LINAC can be operated at an interleaving operation between 9 MeV, 6 MeV and 3 MeV, such as for cargo inspection where it is interleaved between 9 MeV and 6 MeV to detect high atomic number (Z) objects which may be fissionable materials or shielding for radioactive materials, and interleaved between 6 MeV and 3 MeV to detect low Z explosive materials. In each of these two energy interleaved operations, the pulse length of the electron beam from the electron gun used to provide the output of electrons at the lower energy can be higher than the pulse length of the electron beam from the electron gun used to provide the output of electrons at the higher energy, for example, by a factor of about 3, about 4, about 5, or even up to about 10. Such differing pulse length for the two output energies of operation can cause both x-rays of substantially similar x-ray intensities at the detector. For example, for a LINAC operating to provide outputs of electrons at 6 MeV and 9 MeV, it can take about 3 times more electrons at the 6 MeV operation to provide substantially the same x-ray yield as the electrons at the 9 MeV operation. As another example, for a LINAC operating to provide outputs of electrons at 3 MeV and 6 MeV, it can take about 6 times more electrons at the 3 MeV operation to provide substantially the same x-ray yield as the electrons at the 6 MeV operation. In another example, in each of the dual energy operations, where the lower energy operation of the LINAC takes about 160 mA higher captured beam current than the higher energy operation, the difference in pulse length can be smaller, such as by a factor of a little more than about 1, up to about 2, or up to about 3, to equalize the x-ray yields for the two energies.

The x-ray dose per pulse also can be controlled by changing the current of each energy beam in the same direction while maintaining a constant difference between the captured electron beam current between the different energies of operation. That is, in a specific example where a difference of output energies of about 3 MeV is obtained with a difference in captured electron beam current of about 160 mA, then the first captured electron beam current and the second captured electron beam current can both be increased or decreased by substantially the same amount to maintain the same difference between the two values.

A simplified control system can be used with the systems and methods disclosed herein, to control the change of the electron gun current between pulses, which can also be used to control the captured electron beam current. The simplified control system can be used to control the beam pulse length also from pulse to pulse. That is, in an example system, one or more control units can be interfaced with the magnetron, the electron gun, and the LINAC structure. The one or more control units interfaced with the magnetron can issue one or more commands to cause the magnetron to generate the first and second electromagnetic waves to the LINAC (see steps 20 and 24 of FIG. 2, respectively). The one or more control units interfaced with the electron gun can issue one or more commands to cause the first gun current and second gun current to be applied to the electron gun, and to cause the electron gun to eject the first set of electrons and second set of electrons into the accelerator structure (see steps 22 and 26 of FIG. 2, respectively).

5.2 Magnetron

A magnetron functions as a high-power oscillator, to generate electromagnetic waves (usually microwave) pulses of several microseconds duration and with a repetition rate of several hundred pulses per second. The frequency of the electromagnetic waves within each pulse can be typically about 3,000 MHz (S-band) or about 9,000 MHz (X-band). For very high peak beam currents or high average currents, 800 to 1500 MHz (L-band) pulses can be used. The magnetron can be any magnetron deemed suitable by one of skill. For example, the CTL X-band pulsed magnetron, model number PM-1100X (L3 Communications, Applied Technologies, Watsonville, Calif.) can be used.

Typically, the magnetron has a cylindrical construction, having a centrally disposed cathode and an outer anode, with resonant cavities machined out of a solid piece of copper. The space between the centrally disposed cathode and the outer anode can be evacuated. The cathode can be heated by an inner filament; the electrons are generated by thermionic emission. A static magnetic field can be applied perpendicular to the plane of the cross-section of the cavities (for example, perpendicular to a pulsed DC electric field), and a pulsed DC electric field applied between the cathode and the anode. The electrons emitted from the cathode can be accelerated toward the anode by the action of the pulsed DC electric field and under the influence of the magnetic field. Thus, the electrons can be moved in a complex spiraling motion towards the resonant cavities, causing them to radiate electromagnetic radiation at a frequency in the microwave region of the electromagnetic spectrum. The generated microwave pulses can be coupled into to an accelerator structure via a transfer waveguide.

Magnetrons can operate at 1 or 2 MW peak power output to power low-energy LINACs (6 MV or less). Magnetrons can be relatively inexpensive and can be made compact, which can be an advantage for many applications. Continuous-wave magnetron devices can have an output power as high as about 100 kW at 1 GHz with efficiencies of about 75-85 percent, while pulsed devices can operate at about 60-77 percent efficiency. Magnetrons can be used in single-section low energy linear accelerators that may not be sensitive to phase. Feedback systems can be interfaced with the magnetron to stabilize the frequency and power of the electromagnetic wave output.

5.3 Structure of a TW LINAC

Figure 3:
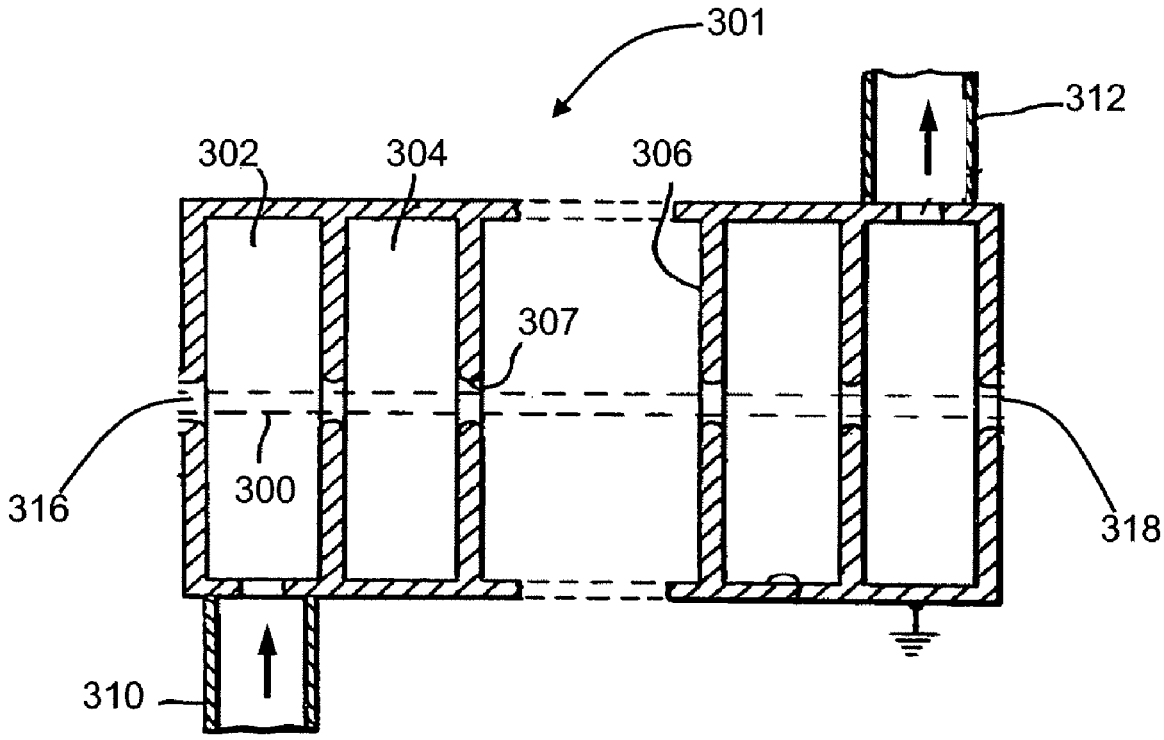
FIG. 3 shows the cross-section of the accelerating structure of a TW LINAC.

The systems and methods disclosed herein are applicable to TW LINACs. FIG. 3 illustrates an example accelerating structure of a TW LINAC.

FIG. 3 illustrates an example cross-section of a forward wave TW LINAC structure. In an embodiment, accelerating structure 301 has a cylindrical cross-section. The TW LINAC comprises an accelerating structure 301 that has a longitudinal passageway 300 and a plurality of cavities 302, 304 positioned along the central bore of the accelerating structure, and separated by transverse panels 306. Transverse panels 306 can be metallic discs. Each transverse panel 306 has central orifices 307 aligned along the longitudinal axis of the accelerating structure 301 to form longitudinal passageway 300 running down the center of the accelerating structure. The electromagnetic wave is coupled through these central orifices. Those of skill in the art will recognize that a traveling wave LINAC can have at least 5, at least 10, at least 15, at least 20, at least 25, at least 30, at least 35, at least 40, or more cavities. In an exemplary embodiment where the accelerating structure 301 has a cylindrical cross-section, transverse panel 306 can be a disc.

During operation, the electromagnetic wave is fed in from input waveguide 310 to accelerating structure 301. The electromagnetic wave flows downstream of the electron beam and is coupled out into waveguide 312 after one passage through accelerating structure 301. In operation of the TW LINAC, a beam of electrons injected into an input orifice 316 of the longitudinal passageway 300 of the TW LINAC is accelerated by the electromagnetic wave along the longitudinal passageway 300 and emitted from an output orifice 318. In applications that use x-ray radiation, the emitted electron beam can be directed at an x-ray target (not shown). The generation of x-rays and examples of targets are discussed in Section 5.5 below.

5.4 LINAC Operating System

Figure 4:
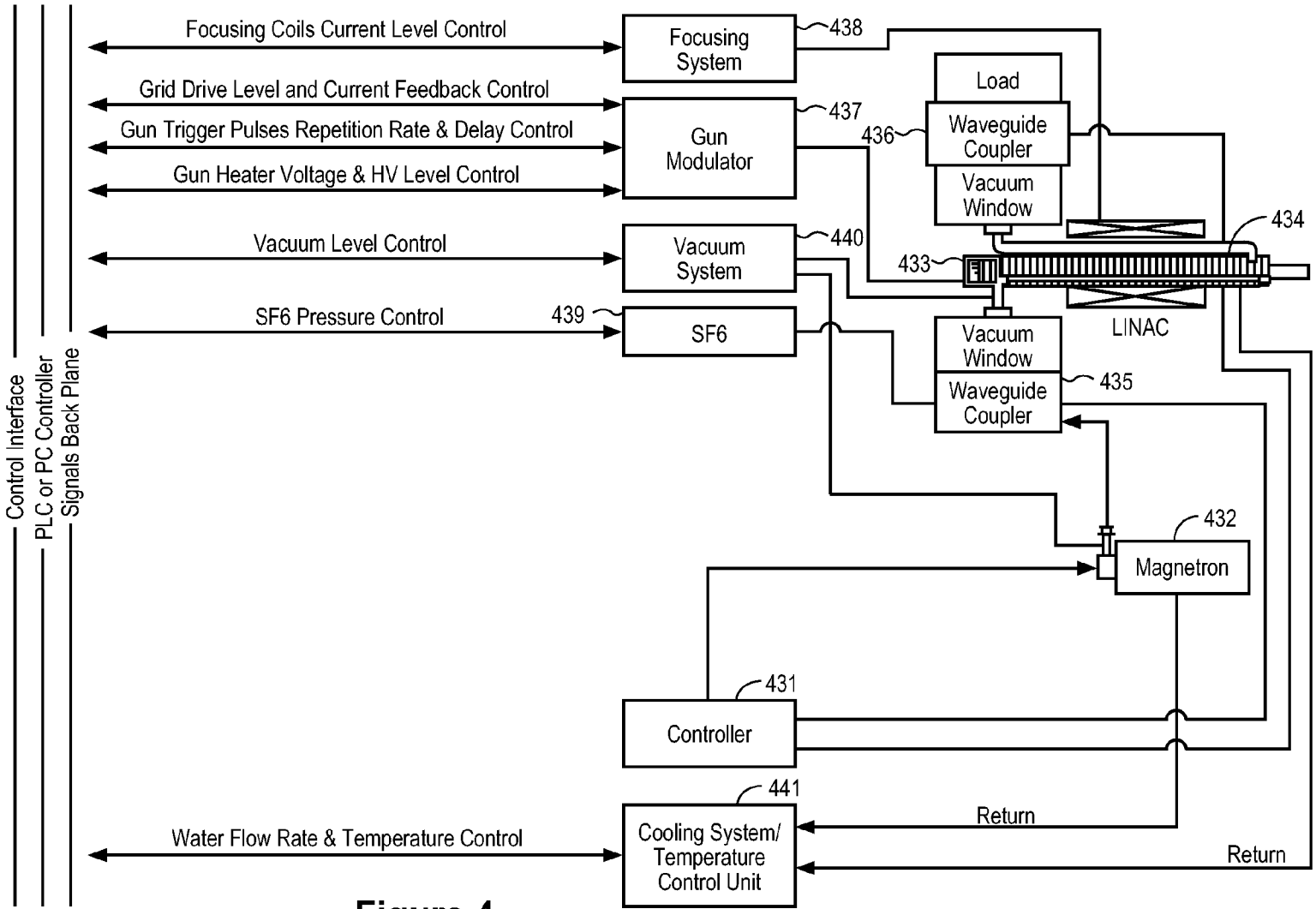
FIG. 4 illustrates a block diagram of a system for operating a multi-energy LINAC powered by a magnetron.

FIG. 4 illustrates a block diagram of an exemplary multi-energy LINAC 34 and operating system components. The illustrated operating system for a LINAC includes a control interface through which a user can adjust settings, control operation, etc. of the LINAC. The control interface communicates with a programmable logic controller (PLC) and/or a personal computer (PC) that is connected to a signal backplane. The signal backplane provides control signals to multiple different components of the LINAC based on instructions received from the PLC, PC and/or control interface.

A controller 431 (a control unit) receives tuning control information from the signal backplane. The controller 431 can be interfaced with a magnetron 432, an electron gun 433, and/or one or more other components of the LINAC 434. In the illustration of FIG. 4, LINAC 434 is a TW LINAC where the controller 431 interfaces with the input waveguide 435 and the output waveguide 436.

A waveguide 435 couples the magnetron 432 to an input of the LINAC 434. The waveguide 435 includes a waveguide coupler and a vacuum window. The waveguide 435 carries high powered electromagnetic waves (carrier waves) generated by the magnetron 432 to the accelerator structure of the LINAC 434. The waveguide coupler of waveguide 435 can sample a portion of the electromagnetic wave power to the input of the LINAC. A waveguide 436 that includes a waveguide coupler and a vacuum window couples the output of the accelerator structure of the LINAC 434 to the RF load. Waveguide 435 or waveguide 436 can be a rectangular or circular metallic pipe that is configured to optimally guide waves in the frequencies that are used to accelerate electrons within the LINAC without significant loss in intensity. The metallic pipe can be a low-Z, high conductivity, material such as copper. To provide the highest field gradient possible with near maximum input power, the waveguide can be filled with $SF_6$ gas. Alternatively, the waveguides can be evacuated.

The vacuum window permits the high power electromagnetic waves to enter the input of the LINAC 434 while separating the evacuated interior of the LINAC 434 from its gas filled or evacuated exterior.

A gun modulator 437 controls an electron gun (not shown) that fires electrons into the LINAC 434. The electron gun can be any electron gun deemed suitable by one of skill. For example, the L3, model number M592 (L3 communications, Electron Devices, San Carlos, Calif.) can be used. The gun modulator 437 receives grid drive level and current feedback control signal information from the signal backplane. The gun modulator 437 further receives gun trigger pulses and delay control pulse and gun heater voltage and HV level control from the signal backplane. The gun modulator 437 controls the electron gun by instructing it when and how to fire (e.g., including repetition rate and grid drive level to use). The gun modulator 437 can cause the electron gun to fire the electrons at a pulse repetition rate that corresponds to the pulse repetition rate of the high power electromagnetic waves (carrier waves) supplied by the magnetron 432. One or more controllers interfaced with the gun modulator 437 or electron gun can provide instructions to cause the electron gun to deliver a beam current to the accelerator, or to determine the pulse length of the injection of electrons.

An example electron gun includes an anode, a grid, a cathode and a filament. The filament is heated to cause the cathode to release electrons, which are accelerated away from the cathode and towards the anode at high speed. The focus electrode and the anode can focus the stream of emitted electrons into a beam of a controlled diameter. The grid can be positioned between the anode and the cathode.

The electron gun is followed by a buncher that is located after the electron gun and is typically integral within the accelerating structure of the LINAC 434. In one embodiment, the buncher is composed of the first few cells of the accelerating structure of the LINAC 434. The buncher packs the electrons fired by the electron gun into bunches and produces an initial acceleration. Bunching is achieved because the electrons receive more energy from the electromagnetic wave (more acceleration) depending on how near they are to the crest of the electromagnetic wave. Therefore, electrons riding higher on the electromagnetic wave catch up to slower electrons that are riding lower on the electromagnetic wave. The buncher applies the high power electromagnetic waves provided by the magnetron 432 to the electron bunch to achieve electron bunching and the initial acceleration.

High power electromagnetic waves are injected into the LINAC 434 from the magnetron 432 via the waveguide 435. Electrons to be accelerated are injected into the LINAC 434 by the electron gun. The electrons enter the LINAC 434 and are typically bunched in the first few cells of the LINAC 434 (which may comprise the buncher). The LINAC 434 is a vacuum tube that includes a sequence of tuned cavities separated by irises. The tuned cavities of the LINAC 434 are bounded by conducting materials such as copper to keep the energy of the high power electromagnetic waves from radiating away from the LINAC 434, and to form a propagating mode with a high longitudinal electric field on the axis of the accelerator structure.

In the first portion of the LINAC, each successive cavity is longer than its predecessor to account for the increasing particle speed. Typically, after the first dozen or so cells the electrons reach about 98% of the velocity of light and the rest of the cells are all the same length. The basic design criterion is that the phase velocity of the electromagnetic waves matches the particle velocity at the locations of the cavities in the LINAC 434 where acceleration (but not bunching) occurs.

Once the electron beam has been accelerated by the LINAC 434, it can be directed at a target, such as a tungsten target, that can be positioned at the end of the LINAC 434. The bombardment of the target by the electron beam generates a beam of x-rays (discussed in Section 5.5 below). The electrons can be accelerated to different energies using the beam loading effect as discussed in Sections 5.1.1 above before they strike a target. In an interleaving operation, the electrons can be alternately accelerated to two or more different output energies, e.g., to about 3 MeV, to about 6 MeV and to about 9 MeV.

For a TW LINAC, to achieve a light weight and compact size, the TW LINAC can be operated in the X-band (e.g., at an RF frequency between 8 GHz and 12.4 GHz). The high operating frequency, relative to a conventional S-band LINAC, can reduce the length of the LINAC 434 by approximately a factor of three, for a given number of accelerating cavities, with a concomitant reduction in mass and weight. As a result, the components of the TW LINAC can be packaged in a relatively compact assembly. Alternatively, the TW LINAC can operate in the S-band. Such a TW LINAC can require a larger assembly, but can provide a higher energy X-ray beam (e.g., up to about 18 MeV) with commercially available high power electromagnetic wave sources.

A focusing system 438 controls powerful electromagnets that surround the LINAC 434. The focusing system 438 receives a current level control from the signal backplane, and controls a current level of focusing coils to focus an electron beam that travels through the LINAC 434. The focusing system 438 is designed to focus the beam to concentrate the electrons to a specified diameter beam that is able to strike a small area of the target. The beam can be focused and aligned by controlling the current that is supplied to the electromagnet. In an example, the focusing current can remain constant between pulses, and the current can be maintained at a value which allows the electromagnet to substantially focus the beam for each of the different energies of operation.

A sulfur hexafluoride ($SF_6$) controller 439 receives pressure control information from the backplane and can control an amount (e.g., at a specified pressure) of $SF_6$ gas, a dielectric gas and insulating material, that can be pumped into the waveguides 435 and 436. The $SF_6$ controller receives pressure control information from the backplane and uses the received information to control the pressure of $SF_6$ gas that is supplied to the waveguide. The $SF_6$ gas can increase the amount of peak power that can be transmitted through waveguides 435 and 436, and can increase the voltage rating of the LINAC.

A vacuum system 440 (e.g., an ion pump vacuum system) can be used to maintain a vacuum in both the magnetron 432 and the LINAC 434, and to report current vacuum levels (pressure) to the signal backplane. A vacuum system also can be used to generate a vacuum in portions of the waveguides 435 and 436.

A cooling system/temperature control unit 441 can be used to monitor the temperature of one or more components of the system and to control a cooling system to maintain a constant temperature of these components. For example, the cooling system can circulate water or other coolant to regions that need to be cooled, such as the magnetron 432 and the LINAC 434. The temperature of the metal of the LINAC and the magnetron may rise as much as 10° C. when the LINAC is operated at a high repetition rate, which can contribute to a drift in the electromagnetic wave. For example, when the LINAC changes temperature, the magnetron oscillating frequency must be tuned to keep the RF phase difference constant from the input to the output of the LINAC.

Figure 5:
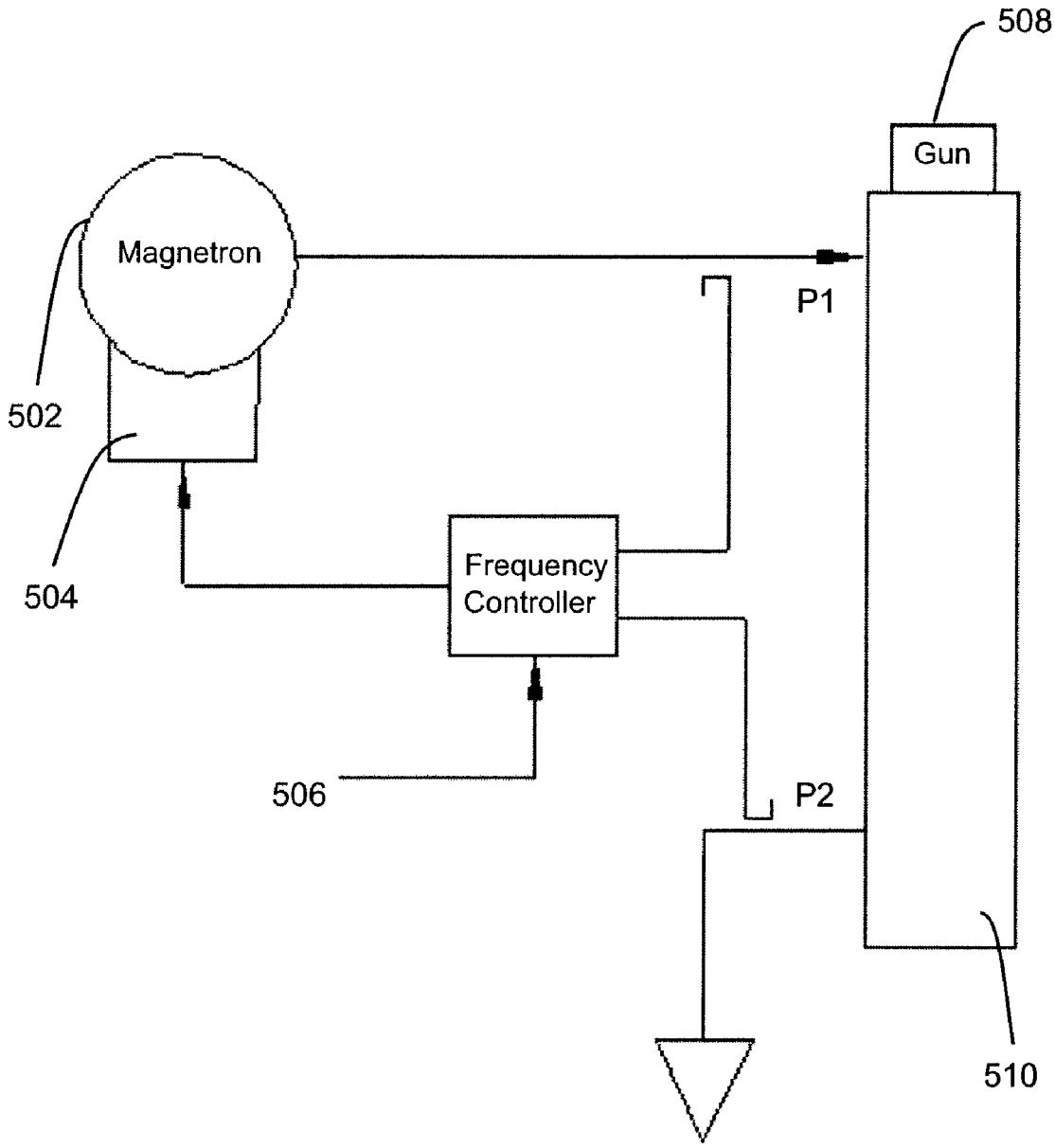
FIG. 5 illustrates a block diagram of a TW LINAC comprising a frequency controller.

FIG. 5 shows a block diagram of an embodiment of a TW LINAC system that includes a magnetron 502, a tuner 504 interfaced with the magnetron 502, a frequency controller 506, an electron gun 508, and an accelerator structure 510. The frequency controller 506 can be used to measure the phase of the electromagnetic wave near the output coupler relative to the phase of the electromagnetic wave near the input coupler. In the illustration of FIG. 5, the frequency controller 506 includes a controller and a phase comparator. The phase comparator of frequency controller 506 can compare the electromagnetic wave at the input of the accelerator structure 510 (P1) and at the output of the accelerator structure 510 (P2) and provides a measure of the phase shift ($\Delta P$) to the controller of frequency controller 506.

With this information, the frequency controller 506 can be used to maintain the phase shift through the LINAC at the same set point for the different energies of operation of the LINAC. Specifically, the frequency controller 506 can transmit a signal to the tuner 504 to tune the magnetron in order to maintain the phase shift of the electromagnetic wave at the set point. For example, if the measured phase shift of the first electromagnetic wave (generated at a first frequency) is not at the set point, the frequency controller 506 can transmit a signal to the tuner 504 to tune the magnetron to generate a second electromagnetic wave at a modified frequency (i.e., to a second frequency that is not equal to the first frequency) to cause the phase shift of the second electromagnetic wave to be closer to the set point. The first frequency and the second frequency are different if they differ by greater than about 0.001% in magnitude, greater than about 0.002% in magnitude, or more. If the measured phase shift of the first electromagnetic wave (generated at a first frequency) is at the set point, the frequency controller 506 can transmit a signal to the tuner 504 so that the magnetron to generate the second electromagnetic wave at substantially the same frequency as the first electromagnetic wave. For example, the first frequency and the second frequency can be substantially the same frequency if they differ by less than about 0.001%. That is, a measurement of the phase difference between P1 and P2 can cause the magnetron to be tuned to alter its operating frequency, if necessary, and thereby maintain a specific phase shift of the electromagnetic waves through the accelerator structure.

Thus, the signal from the frequency controller 506 to the magnetron can ultimately result in maintaining the phase shift of the electromagnetic waves through the accelerator structure at a set point, based on the magnitude of the phase shift detected by the frequency controller. In a non-limiting example, the frequency controller can be an automatic frequency controller (AFC). The frequency controller is illustrated in FIG. 5 as comprising a controller and a phase comparator as an integral unit. However, in other embodiments, the frequency controller 506 can comprise the controller and phase comparator as separate units.

The frequency of the electromagnetic wave generated by the magnetron can be tuned mechanically. For example, a tuning pin or a tuning slug positioned in communication with the body of the magnetron can be moved in or out of the body of the magnetron to tune its operating frequency. Tuner 504 can include a motor drive that moves the tuning pin or tuning slug to tune the magnetron mechanically. In an embodiment where the magnetron is operated to generate electromagnetic waves at substantially a single frequency (or at values of frequency (f) within a range (δf) around the single frequency), the mechanical tuning can be used to maintain the stability of the performance of the magnetron. For example, δf can be a difference on the order of about one or a few parts in 10,000 of a frequency in kHz. In some embodiments, δf can be a difference on the order of about 0.01 MHz or more, about 0.03 MHz or more, about 0.05 MHz or more, about 0.08 MHz or more, about 0.1 MHz or more. As described in greater detail below, the frequency controller can be used to maintain the stability of the output energy and electron dose stability.

When the TW LINAC is operated at two or more different energies, the magnetron can be tuned to operate at a range of values (δf) around a single frequency (f) that provides for a maximized output of the LINAC at all of the different energies of operation. For example, in an embodiment where the LINAC is operated at 6 MeV and 9 MeV, the magnetron can be operated to generate electromagnetic waves at values within a range (δf) around a single frequency (f) such that the electron bunches are accelerated on average slightly ahead of the peak of the electromagnetic wave during the 9 MeV operation and are accelerated on average slightly behind the peak of the electromagnetic wave during the 6 MeV.

The single frequency of operation of the magnetron can be determined by first finding an intermediate electron gun current between those used for the two different energies of operation, for which adjusting the frequency of the magnetron to optimize the x-ray yield of the LINAC provides acceptable energy spectrum and stability for both the highest energy operation and the lowest energy. The intermediate electron gun current can be, but is not limited to, an average or median of the highest electron gun current and the lowest electron gun current for a two-energy operation or for operation at three or more different energies. The single frequency of operation of the magnetron, and the range of values (60 around the single frequency, can be determined as the frequency (and δf) that maximizes a x-ray yield of the LINAC for that intermediate electron gun current. The frequency controller can facilitate stable operation during rapid switching of a multi-energy interleaved operation of the TW LINAC. The frequency controller can be used to correct for the effect of rapid thermalization of the TW LINAC accelerator structure when the system is stepping from standby to full power, drifts in the temperature of the accelerator structure cooling water, or drifts in the frequency of the magnetron.

Figure 6:
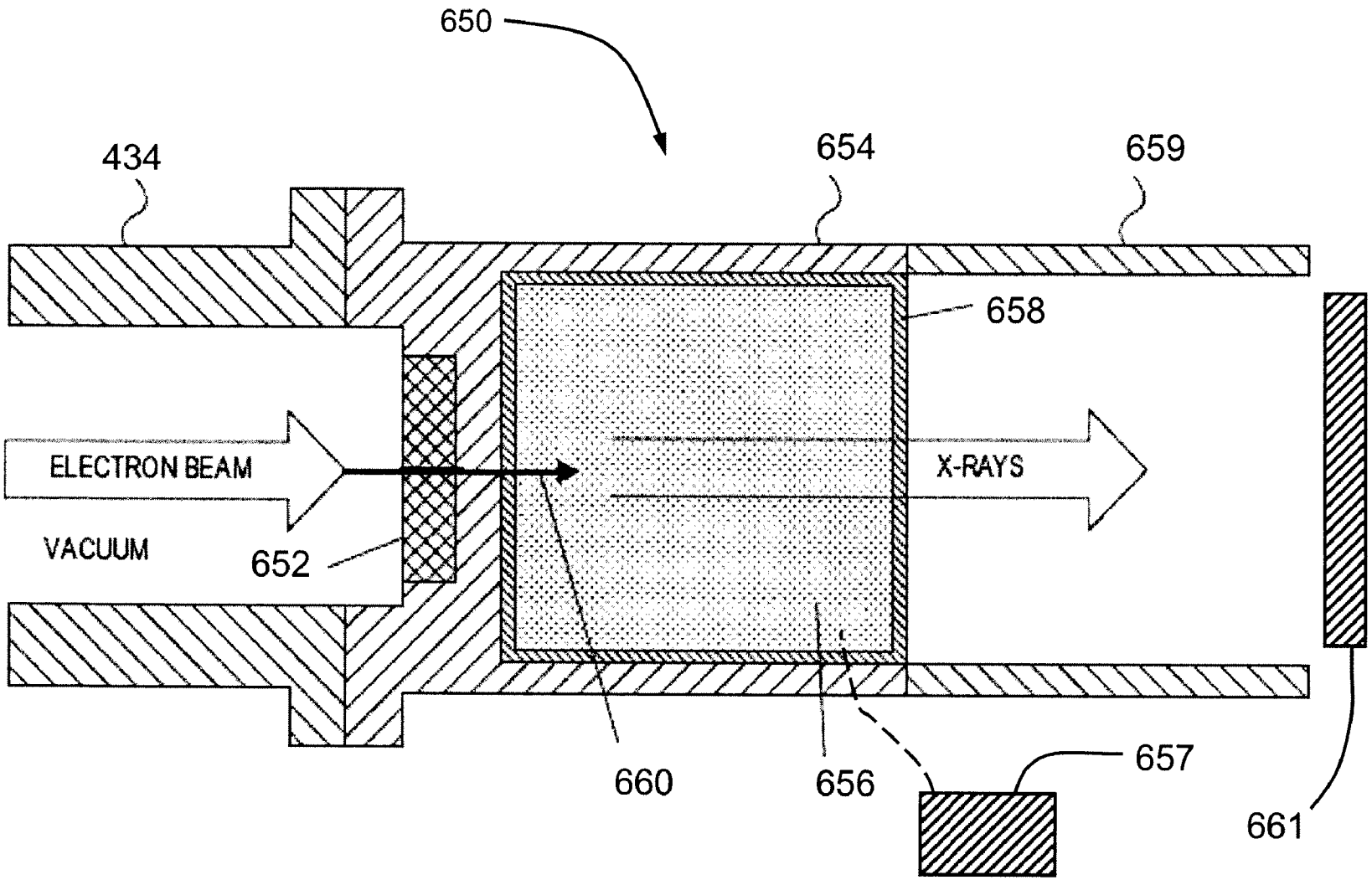
FIG. 6 illustrates a cross-section of a target structure coupled to the LINAC accelerator structure.

FIG. 6 illustrates a cross-section of a target structure 650 coupled to the LINAC 434 (partially shown). The target structure 650 includes a target 652 to perform the principal conversion of electron energy to x-rays. The target 652 may be, for example, an alloy of tungsten and rhenium, where the tungsten is the principle source of x-rays and the rhenium provides thermal and electrical conductivity and improved ductility for easier machining and longer lifetime with thermal shocks. In general, the target 652 may include one or more target materials having an atomic number approximately greater than or equal to 70 to provide efficient x-ray generation. In an example, the x-ray target can include a low-Z material such as but not limited to copper, which can avoid or reduce generation of neutrons when bombarded by the output electrons.

When electrons from the electron beam enter the target, they give up energy in the form of heat and x-rays (photons), and lose velocity. In operation, an accelerated electron beam impinges on the target, generating Bremsstrahlung and k-shell x-rays (see Section 5.5 below).

The target 652 may be mounted in a metallic holder 654, which may be a good thermal and electrical conductor, such as copper. The holder 654 may include an electron collector 656 to collect electrons that are not stopped within the target 652 and/or that are generated within the target 652. The collector 656 may be a block of electron absorbing material such as a conductive graphite based compound. In general, the collector 656 may be made of one or more materials with a low atomic number, for example, an atomic number approximately less than or equal to 6, to provide both electron absorption and transparency to x-rays generated by the target 652. The collector 656 may be electrically isolated from a holder by an insulating layer 658 (e.g., a layer of anodized aluminum). In an example, the collector 656 is a heavily anodized aluminum slug. Measurement of the current collected in the collector can be used to provide an indication of the energy of the electron beam (including the captured electron beam).

A collimator 659 can be attached to the target structure. The collimator 659 shapes the X-ray beam into an appropriate shape. For example, if the LINAC is being used as an X-ray source for a cargo inspection system, the collimator 659 may form the beam into a fan shape. The X-ray beam may then penetrate a target (e.g., a cargo container), and a detector at an opposite end of the target may receive X-rays that have not been absorbed or scattered. The received X-rays may be used to determine properties of the target (e.g., contents of a cargo container).

An x-ray intensity monitor 651 can be used to monitor the yield of the x-ray during operation (see FIG. 6). A non-limiting example of an x-ray intensity monitor 661 is an ion chamber. The x-ray intensity monitor 651 can be positioned at or near the x-ray source, for example, facing the target. In one embodiment, based on measurements from the x-ray intensity monitor 651 from one pulse of the LINAC to another, the controller 431 can transmit a signal to a controller of the electron gun to cause a higher (or lower) beam current to be applied to the electron gun (as discussed above in Section 5.1) in order to maintain a substantially similar dose of x-rays from pulse to pulse. In another embodiment, based on measurements from the x-ray intensity monitor 651, the controller 431 can transmit a signal to a controller of the electron gun to cause the electron gun to provide a beam of electrons at a longer (or shorter) pulse length (as discussed above in Section 5.1) in order to maintain a substantially similar dose of x-rays from pulse to pulse.

The operation of the exemplary TW LINAC, for example, to position the electron bunch relative to the crest of the traveling electromagnetic wave to optimize the energy spectrum, is disclosed in co-pending Nonprovisional application Ser. No. 12/581,086 (which is incorporated herein by reference in its entirety).

5.5 X-Rays

In certain aspects, x-rays can be generated from the bombardment of a target material by the accelerated electron beam or electron bunches from a LINAC. The x-rays can be generated by two different mechanisms. In the first mechanisms, collision of the electrons from the LINAC with an atom of a target can impart enough energy so that electrons from the atom's lower energy levels (inner shell) escape the atom, leaving vacancies in the lower energy levels. Electrons in the higher energy levels of the atom descend to the lower energy level to fill the vacancies, and emit their excess energy as x-ray photons. Since the energy difference between the higher energy level and the lower energy level is a discrete value, these x-ray photons (generally referred to as k-shell radiation) appear in the x-ray spectrum as sharp lines (called characteristic lines). K-shell radiation has a signature energy that depends on the target material. In the second mechanisms, the electron beams or bunches from the LINAC are scattered by the strong electric field near the atoms of the target and give off Bremsstrahlung radiation. Bremsstrahlung radiation produces x-rays photons in a continuous spectrum, where the intensity of the x-rays increases from zero at the energy of the incident electrons. That is, the highest energy x-ray that can be produced by the electrons from a LINAC is the highest energy of the electrons when they are emitted from the LINAC. The Bremsstrahlung radiation can be of more interest than the characteristic lines for many applications.

Materials useful as targets for generating x-rays include tungsten, certain tungsten alloys (such as but not limited to tungsten carbide, or tungsten (95%)-rhenium (5%)), molybdenum, copper, platinum and cobalt.

5.6 Instrumentation

Certain instruments that may be used in the operation of a traveling wave LINAC include a modulator, a phase bridge, a vacuum gauge or an ion pump current gauge, an oscilloscope, and a beam current monitor.

5.6.1 Modulators

A modulator for the magnetron generates high-voltage pulses lasting a few microseconds. These high-voltage pulses can be supplied to the magnetron. A power supply provides DC voltage to the modulator, which converts this to the high-voltage pulses. For example, the Solid State Magnetron Modulator-M1 or -M2 (ScandiNova Systems AB, Uppsala, Sweden) can be used in connection with the magnetron.

A gun driver or gun deck can be used to operate the electron gun.

5.7 Exemplary Apparatus and Computer-Program Implementations

Aspects of the methods disclosed herein can be performed using a computer system, such as the computer system described in this section, according to the following programs and methods. For example, such a computer system can store and issue commands to facilitate modification of the electromagnetic wave frequency according to a method disclosed herein. In another example, a computer system can store and issue commands to facilitate operation of the controller of the magnetron or the controller of the electron gun according to a method disclosed herein. The systems and methods may be implemented on various types of computer architectures, such as for example on a single general purpose computer, or a parallel processing computer system, or a workstation, or on a networked system (e.g., a client-server configuration such as shown in FIG. 7).

Figure 7:
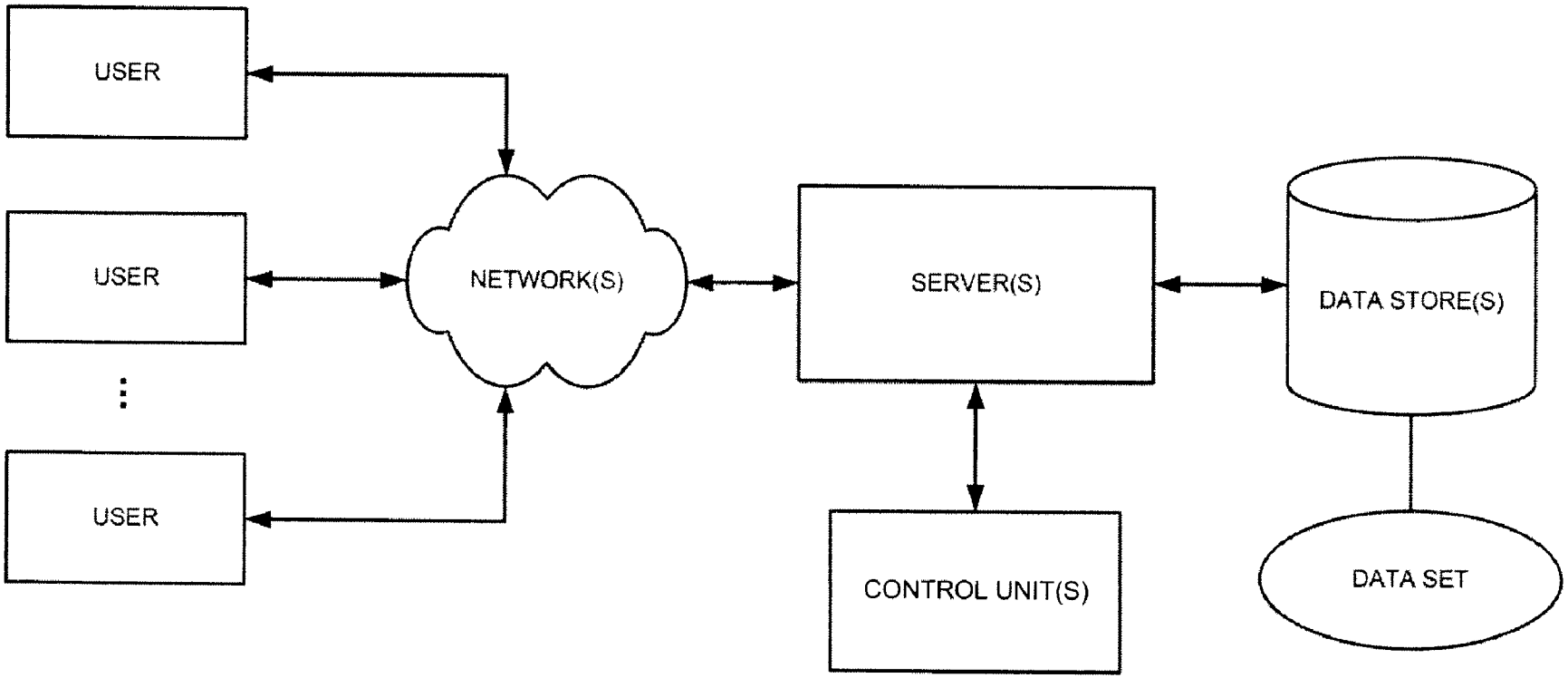
FIG. 7 shows a block diagram of an example computer structure for use in the operation of a LINAC powered by a magnetron.

An exemplary computer system suitable for implementing the methods disclosed herein is illustrated in FIG. 7. As shown in FIG. 7, the computer system to implement one or more methods and systems disclosed herein can be linked to a network link which can be, e.g., part of a local area network ("LAN") to other, local computer systems and/or part of a wide area network ("WAN"), such as the Internet, that is connected to other, remote computer systems. A software component can include programs that cause one or more processors to issue commands to one or more control units, which cause the one or more control units to issue commands to cause the initiation of the controller of the magnetron or the controller of the electron gun, to operate the magnetron to generate an electromagnetic wave at a frequency, and/or to operate the LINAC (including commands for coupling the electromagnetic wave into the LINAC). The programs can cause the system to retrieve commands for executing the steps of the methods in specified sequences, including initiating one or more controllers and operating the magnetron to generate an electromagnetic wave at a frequency, from a data store (e.g., a database). Such a data store can be stored on a mass storage (e.g., a hard drive) or other computer readable medium and loaded into the memory of the computer, or the data store can be accessed by the computer system by means of the network.

In addition to the exemplary program structures and computer systems described herein, other, alternative program structures and computer systems will be readily apparent to the skilled artisan. Such alternative systems, which do not depart from the above described computer system and programs structures either in spirit or in scope, are therefore intended to be comprehended within the accompanying claims.

6. RESULTS

Certain results have been discussed previously. This section provides additional results or further discusses some of the results already discussed hereinabove.

In a X-band TW LINAC having a length of about 0.5 m, changing the captured beam current by about 160 mA can result in a change in the output energy of the TW LINAC by about 3 MeV. For example, if a beam current of 25 mA provides an output of about 9 MeV, then a beam current of 185 mA can provide an output of about 6 MeV beam. A beam current of 105 mA can provide a third energy beam of about 7.5 MeV.

The X-ray dose per pulse can be controlled by changing the pulse length of the beam from the electron gun, or by changing the current of each energy beam in the same direction while maintaining the current differences between each desired energy beam. The magnetron can be run with a single frequency which optimizes the energy spectra of the different energies of operation of the TW LINAC.

A TW LINAC can be run at two different energies, e.g., about 9 MeV and about 6 MeV interleaved, with the magnetron run at a single frequency and a single RF power amplitude. The TW LINAC also can be run at 8 MeV and 5 MeV, with a good spectrum at both energies, by changing the electron gun current for each different energy but maintain substantially the same frequency and power amplitude of the electromagnetic wave from the magnetron.

7. REFERENCES CITED

All references cited herein are incorporated herein by reference in their entirety and for all purposes to the same extent as if each individual publication or patent or patent application was specifically and individually indicated to be incorporated by reference in its entirety herein for all purposes. Discussion or citation of a reference herein will not be construed as an admission that such reference is prior art to the present invention.

8. MODIFICATIONS

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled. In particular, the skilled artisan will appreciate that the teachings of the present invention enable and cover the apparatus and method of operating a magnetron driven LINAC to generate electron beams or x-rays at a variety of multiple energies, one example of which is 6 and 9 MeV x-ray beams.

What is claimed is:

1. A method for generating electrons of different ranges of energies using a traveling wave linear accelerator, the method comprising:

(a) generating electrons having a first range of energies by performing the steps of:

coupling a first electromagnetic wave generated by a magnetron into the traveling wave linear accelerator;

ejecting a first beam of electrons with a first electron beam current and a first pulse length from an electron gun into the accelerator;

accelerating the first beam of electrons with the first electromagnetic wave to the first range of energies, the first range of energies being based upon the first electron beam current; and outputting the first beam of electrons from the accelerator at a first dose based on the first pulse length and at a first captured electron beam current;

(b) generating electrons having a second range of energies value by performing the steps of:

coupling a second electromagnetic wave generated by the magnetron into the accelerator;

ejecting a second beam of electrons with a second electron beam current and a second pulse length from the electron gun into the accelerator, the second electron beam current being different from the first electron beam current, the second pulse length being different from the first pulse length;

accelerating the second beam of electrons with the second electromagnetic wave to the second range of energies, the second range of energies being based upon the second electron beam current, a central value of the second range of energies being different from a central value of the first range of energies; and outputting the second beam of electrons from the accelerator at a second dose based on the second pulse length and at a second captured electron beam current, wherein a magnitude of the second captured electron beam current is different from a magnitude of the first captured electron beam current; and (c) interleaving the first and second ranges of energies by repeating steps (a) and (b).

2. The method of claim 1, wherein the magnitude of the second captured electron beam current differs from the magnitude of the first captured electron beam current by about 160 mA, and wherein the central value of the second range of energies differs from the central value of the first range of energies by about 3 MeV.

3. The method of claim 1, wherein the magnitude of the second captured electron beam current differs from the magnitude of the first captured electron beam current by about 53 mA for each approximately 1 MeV difference between the central value of the second range of energies and the central value of the first range of energies.

4. The method of claim 1, wherein the magnitude of the second captured electron beam current is less than the magnitude of the first captured electron beam current, and wherein the central value of the second range of energies is greater than the central value of the first range of energies.

5. The method of claim 1, wherein the magnitude of the second captured electron beam current is greater than the magnitude of the first captured electron beam current, and wherein the central value of the second range of energies is less than the central value of the first range of energies.

6. The method of claim 1, wherein the second pulse length of the second beam of electrons is shorter than the first pulse length of the first beam of electrons.

7. The method of claim 1, wherein the second pulse length of the second beam of electrons is longer than the first pulse length of the first beam of electrons.

8. The method of claim 1, wherein the central value of the first range of energies and the central value of the second range of energies is a median value or an average value.

9. The method of claim 1, wherein a frequency of the first electromagnetic wave is approximately equal to a frequency of the second electromagnetic wave, and wherein an amplitude of the first electromagnetic wave is approximately equal to an amplitude of the second electromagnetic wave.

10. The method of claim 1, wherein a frequency of the second electromagnetic wave is different from a frequency of the first electromagnetic wave by less than about 0.002%.

11. The method of claim 1, further comprising monitoring a first phase shift of the first electromagnetic wave using a frequency controller interfaced with an input and an output of the accelerator structure, wherein the frequency controller compares a phase of the first electromagnetic wave at the input of the accelerator structure to a phase of the first electromagnetic wave near the output of the accelerator structure to determine a phase shift, wherein the frequency controller transmits a tuning signal to a tuner based on the phase shift.

12. The method of claim 1, further comprising selecting the first and second pulse lengths such that the first dose of the first beam of electrons is substantially the same as the second dose of the second beam of electrons.

13. The method of claim 1, wherein the traveling wave linear accelerator is a constant gradient traveling wave linear accelerator.

14. The method of claim 1, wherein the first and second electromagnetic waves have approximately the same central frequency as one another, the central frequency being selected to optimize the outputs of the first and second beams of electrons.

15. A method for generating x-rays at different ranges of x-ray energies using a traveling wave linear accelerator and an x-ray target, the method comprising:

(a) generating x-rays having a first range of x-ray energies by performing the steps of:

coupling a first electromagnetic wave generated by a magnetron into the traveling wave linear accelerator;

ejecting a first beam of electrons with a first electron beam current and a first pulse length from an electron gun into the accelerator;

accelerating the first beam of electrons with the first electromagnetic wave to a first range of energies, the first range of energies being based upon the first electron beam current;

outputting the first beam of electrons from the accelerator at a first dose based on the first pulse length and at a first captured electron beam current; and contacting the x-ray target with the outputted first beam of electrons, thereby generating a first beam of x-rays having energies in the first range of x-ray energies;

(b) generating x-rays having a second range of x-ray energies by performing the steps of:

coupling a second electromagnetic wave generated by the magnetron into the accelerator;

ejecting a second beam of electrons with a second electron beam current and a second pulse length from the electron gun into the accelerator, the second electron beam current being different from the first electron beam current, the second pulse length being different from the first pulse length;

accelerating the second beam of electrons with the second electromagnetic wave to a second range of energies, the second range of energies being based upon the second electron beam current;

outputting the second beam of electrons from the accelerator at a second dose based on the second pulse length and at a second captured electron beam current, wherein a magnitude of the second captured electron beam current is different from a magnitude of the first captured electron beam current; and contacting the x-ray target with the outputted second beam of electrons, thereby generating a second beam of x-rays having energies in the second range of x-ray energies, a central value of the second range of x-ray energies being different from a central value of the first range of x-ray energies; and (c) interleaving the first and second ranges of x-ray energies by repeating steps (a) and (b).

16. The method of claim 15, wherein the magnitude of the second captured electron beam current differs from the magnitude of the first captured electron beam current by about 53 mA for each approximately 1 MeV difference between the central value of the second range of energies and the central value of the first range of energies.

17. The method of claim 15, wherein the magnitude of the second captured electron beam current is less than the magnitude of the first captured electron beam current, and wherein the central value of the second range of x-ray energies is greater than the central value of the first range of x-ray energies.

18. The method of claim 15, wherein the magnitude of the second captured electron beam current is greater than the magnitude of the first captured electron beam current, and wherein the central value of the second range of x-ray energies is less than the central value of the first range of x-ray energies.

19. The method of claim 15, wherein the second pulse length of the second beam of electrons is longer than the first pulse length of the first beam of electrons.

20. The method of claim 15, wherein the second pulse length of the second beam of electrons is shorter than the first pulse length of the first beam of electrons.

21. The method of claim 15, wherein the central value of the first range of energies and the central value of the second range of energies is a median value or an average value.

22. The method of claim 15, wherein a frequency of the first electromagnetic wave is approximately equal to a frequency of the second electromagnetic wave, and wherein an amplitude of the first electromagnetic wave is approximately equal to an amplitude of the second electromagnetic wave.

23. The method of claim 15, wherein a frequency of the second electromagnetic wave is different from a frequency of the first electromagnetic wave by less than about 0.002%.

24. The method of claim 15, further comprising monitoring a first phase shift of the first electromagnetic wave using a frequency controller interfaced with an input and an output of the accelerator structure, wherein the frequency controller compares a phase of the first electromagnetic wave at the input of the accelerator structure to a phase of the first electromagnetic wave near the output of the accelerator structure to determine a phase shift, wherein the frequency controller transmits a tuning signal to a tuner based on the phase shift.

25. The method of claim 15, further comprising selecting the first and second pulse lengths such that the first dose of the first beam of electrons is substantially the same as the second dose of the second beam of electrons.

26. The method of claim 15, further comprising selecting the first and second pulse lengths such that the first dose of the first beam of x-rays is substantially the same as the second dose of the second beam of x-rays.

27. The method of claim 15, wherein the traveling wave linear accelerator is a constant gradient traveling wave linear accelerator.

28. The method of claim 15, wherein the first and second electromagnetic waves have approximately the same central frequency as one another, the central frequency being selected to optimize the outputs of the first and second beams of electrons.

29. A traveling wave linear accelerator comprising:

a traveling wave linear accelerator structure having an input and an output;

a magnetron coupled to the accelerator structure and configured to provide an electromagnetic wave to the accelerator structure;

an electron gun interfaced with the input of the accelerator structure; and a controller interfaced with the electron gun, wherein the controller is configured to transmit a first signal to cause the electron gun to eject a first beam of electrons at a first electron beam current and a first pulse length into the input of the accelerator structure, wherein the accelerator structure is configured to accelerate the first beam of electrons to a first range of energies using the electromagnetic wave and to output the accelerated first beam of electrons at a first dose based on the first pulse length and at a first captured electron beam current, the first range of energies being based on the first electron beam current, wherein the controller is configured to transmit a second signal to cause the electron gun to eject a second beam of electrons at a second electron beam current different from the first electron beam current and a second pulse length different from the first pulse length into the input of the accelerator structure, wherein the accelerator structure is configured to accelerate the second beam of electrons to a second range of energies using the electromagnetic wave and to output the accelerated second beam of electrons at a second dose based on the second pulse length and at a second captured electron beam current, the second range of energies being based on the second electron beam current, wherein a magnitude of the second captured electron beam current is different from a magnitude of the first captured electron beam current, and wherein a central value of the second range of energies is different from a central value of the first range of energies, the controller further being configured to repeatedly transmit the first and second signals to the electron gun so as to interleave the first and second ranges of energies.

30. The traveling wave linear accelerator of claim 29, further comprising a tuner and a frequency controller interfaced with the input and the output of the accelerator structure, wherein the frequency controller compares a phase at the input of the accelerator structure of the electromagnetic wave to a phase of the electromagnetic wave near the output of the accelerator structure to detect a phase shift of the first electromagnetic wave, wherein the frequency controller transmits a tuning signal to the tuner based on the detected phase shift, and wherein the tuner adjusts a frequency of the electromagnetic wave based on the tuning signal.

31. The traveling wave linear accelerator of claim 29, wherein the second pulse length of the second beam of electrons is shorter than the first pulse length of the first beam of electrons.

32. The traveling wave linear accelerator of claim 29, wherein the second pulse length of the second beam of electrons is longer than the first pulse length of the first beam of electrons.

33. The traveling wave linear accelerator of claim 29, wherein the controller is configured to select the first and second pulse lengths such that the first dose of the first beam of electrons is substantially the same as the second dose of the second beam of electrons.

34. The traveling wave linear accelerator of claim 29, wherein the traveling wave linear accelerator is a constant gradient traveling wave linear accelerator.

35. The traveling wave linear accelerator of claim 29, wherein the first and second electromagnetic waves have approximately the same central frequency as one another, the central frequency being selected to optimize the outputs of the first and second beams of electrons.

* * * * *